US005141053A

United States Patent [19]

Restarick et al.

[11] Patent Number: 5,141,053

[45] Date of Patent: Aug. 25, 1992

[54] COMPACT DUAL PACKER WITH LOCKING DOGS

[75] Inventors: Henry L. Restarick, Plano; Pat M. White, Carrollton, both of Tex.

[73] Assignee: Otis Engineering Corporation, Carrollton, Tex.

[21] Appl. No.: 707,689

[22] Filed: May 30, 1991

[51] Int. Cl.[5] ..... E21B 33/129

[52] U.S. Cl. ..... 166/120; 166/182

[58] Field of Search ..... 166/118-123, 166/126, 128, 134, 182, 142, 146, 206, 209, 212

[56] References Cited

U.S. PATENT DOCUMENTS 4,216,827 8/1980 Crowe ..... 166/182 X
4,423,777 1/1984 Mullins et al. ..... 166/212 X
4,936,387 6/1990 Rubbo ..... 166/120 X

*Primary Examiner*—Thuy M. Bui
*Attorney, Agent, or Firm*—Dennis T. Griggs

[57] ABSTRACT

A compact, retrievable packer has a unitary mandrel body which is intersected by one or more longitudinal production bores. The running length of the packer is reduced and premature set/release are prevented by a lock assembly which releasably locks the lower setting wedge to the packer mandrel. The lock assembly includes one or more locking dogs mounted within mandrel pockets for radial extension and retraction. The locking dogs are extended into an annular slot formed between a retainer collar and the packer mandrel. The lower setting wedge is secured by threaded engagement with the retainer collar. When the locking dogs are extended, the lower setting wedge is blocked against longitudinal displacement, thereby opposing setting forces applied to anchor slips. The locking dogs are held in the locked position by brace rods which are releasably blocked by a shifting sleeve mounted in one of the packer mandrel bores.

10 Claims, 4 Drawing Sheets

COMPACT DUAL PACKER WITH LOCKING DOGS

FIELD OF THE INVENTION

This invention relates to tools and equipment for completing subterranean wells, and in particular to retrievable well packers for securely sealing the annulus between a tubing string and the bore of a surrounding well casing.

BACKGROUND OF THE INVENTION

In the course of treating and preparing subterranean wells for production, a well packer is run into the well on a work string or production tubing. The purpose of the packer is to support production tubing and other completion equipment such as a screen or safety valve adjacent to a producing formation and to seal the annulus between the outside of the production tubing and the inside of the well casing to block movement of fluids through the annulus past the packer location. The packer is provided with slip anchor members having gripping surfaces which cooperate with complementary opposed wedging surfaces, whereby the slip anchor members are extendable radially into gripping engagement against the well casing bore in response to relative axial movement of the wedging surfaces. The packer also carries annular seal elements which expand radially into sealing engagement against the bore of the well casing in response to axial compression forces. Longitudinal movement of the packer components which set the anchor slips and the sealing elements may be produced either hydraulically or mechanically.

DESCRIPTION OF THE PRIOR ART

During run-in, the packer is mechanically locked in the unset condition by shear pins to prevent premature setting. It is essential that the packer remain in the unset condition while withstanding run-in forces caused by jarring, torquing and compression/tension loading as the packer is forced through tight bends, for example in deviated bores and in horizontal completions. Moreover, it is desirable that the packer be retrievable from the well by appropriate manipulation of the tubing string to cause the packer to be unsealed and released from the well bore. In some installations, the packer may be released from set engagement by a straight pull upwardly on the work string, or by rotation of the work string, or by a combination of straight pull and rotation operations.

Some conventional packers include shear pins and ratchet slips which provide packer set and release sequence control. Under certain operating conditions, premature shearing of the shear pins can occur as a result of the static production loading from above the packer and annulus pressure loading applied from below the packer.

In hydraulically actuated packers, the packer mandrel may be subject to burst and collapse as the hydraulic pressure is increased, or pressure differentials above or below increase, and greater setting force is applied to the piston. This causes ratchet slips to lock tighter, and the radial component of the locking force may pinch or collapse the tubular mandrel. Collapse is even more likely to occur for dual bore hydraulic packers in which thin walled mandrels provide increased diameter production bores. For such packers in which external ratchet slips engage the dual mandrels, the mandrel wall thickness must be increased and/or the hydraulic setting pressure must be limited to avoid collapse or pinching damage.

The nominal running length of conventional dual bore packers is in the range of 8-9 feet. The combined effect of the running length, outside diameter and stiffness are factors which limit the use of such conventional dual bore packers in deviated bores or horizontal completions.

OBJECTS OF THE INVENTION

Accordingly, the principal object of the present invention is to reduce the running length of a retrievable well packer so that it can be run through a highly deviated bore, for example short, medium and long radius horizontal well completions.

Another object of the invention is to provide an improved multiple bore hydraulic packer which is capable of withstanding increased setting pressures and operational pressures without collapse or stress failure.

Another object of this invention is to provide an improved mechanical locking apparatus for preventing premature set and release of a packer during running and production, respectively, and which can be released to permit retrieval of the packer.

A related object of this invention is to provide a retrievable well packer having an improved locking apparatus for locking the packer mandrel and lower wedge together during running operations to prevent premature setting caused by jarring and compression/-tension loading as the packer is forced through tight bends, for example in deviated bores and horizontal completions.

Yet another object of the present invention is to provide an improved retrievable packer in which the net pressure loading imposed on release shear screws as a result of loading forces acting from above or below the packer during production operations is minimized.

Another object of the present invention is to improve the weight carrying capacity of a multiple bore hydraulic packer.

SUMMARY OF THE INVENTION

The foregoing objects are achieved according to the present invention by a hydraulic packer having a unitary mandrel body which is intersected by one or more longitudinal bores. Handling forces which arise during run-in and pressure forces which arise during production are decoupled from the packer components by a lock assembly which releasably couples the packer mandrel to the lower setting wedge for blocking longitudinal movement of the packer mandrel relative to the setting wedge during run-in and production. The lock assembly includes one or more locking dogs which are radially extendable and retractable within pockets formed in the packer mandrel body. Each locking dog is radially extendable from the mandrel into an external annular pocket formed by a retainer collar which is secured by a threaded union with the lower setting wedge. The locking dogs are held in the lock position by guide lugs and a shifting sleeve. The guide lugs project through transverse bores between the locking dog pockets and a production bore. The shifting sleeve is installed within the production bore and is releasably secured in blocking engagement with the guide lugs by one or more shear screws.

During run-in and production, the locking dogs and guide lugs are confined against retraction by the shifting sleeve and the retainer collar. The lower setting wedge is therefore secured against longitudinal displacement relative to the packer mandrel during run-in and production operations. Setting forces are reacted through the lower setting wedge, the locking dogs and packer mandrel. Handling forces which arise during run-in and pressure forces which arise during production are also reacted through the locking dogs and packer mandrel, thereby avoiding stress loading of other packer components.

The packer is released by applying a wire line shifting tool against the shifting sleeve to cause separation of the shear pins and displacement of the shifting sleeve out of blocking engagement with the guide lugs. Upon shifting of the shifting sleeve, the guide lugs and locking dogs are free to retract, thereby releasing the lower setting wedge. The packer is then retrieved by a straight upward pull as the anchor slips are released.

The novel features of the invention are set forth with particularity in the claims. The invention will best be understood from the following description when read with reference to the accompanying drawings.

DETAILED DESCRIPTION OF THE PREFERRED EMBODIMENT

Figure 1:
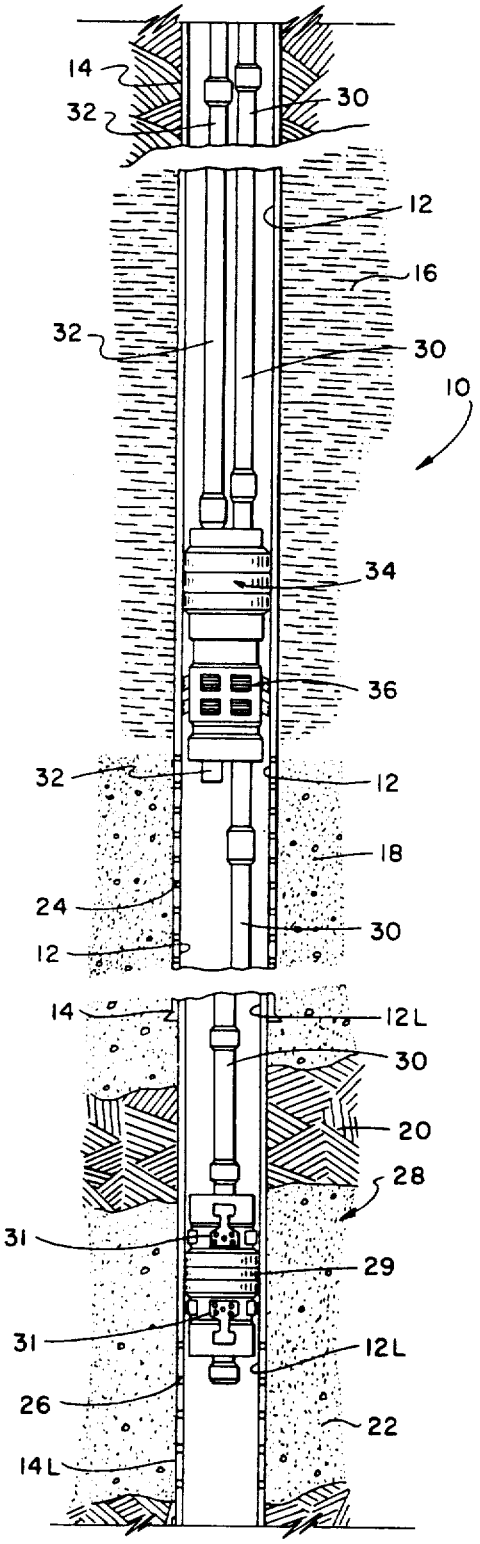
FIG. 1 is a simplified schematic diagram showing a production well intersecting two hydrocarbon producing formations, with the lower producing formation being isolated by a single string bottom packer, and with the upper formation being isolated by a dual string hydraulic set production packer constructed according, to the teachings of the present invention.

In the description which follows, like parts are marked throughout the specification and drawings with the same reference numerals, respectively. The drawings are not necessarily to scale and the proportions of certain parts have been exaggerated to better illustrate details and features of the invention. As used herein, the designation "S" refers to internal and external 0-ring seals and the designation "T" refers to a threaded union.

Figure 2:
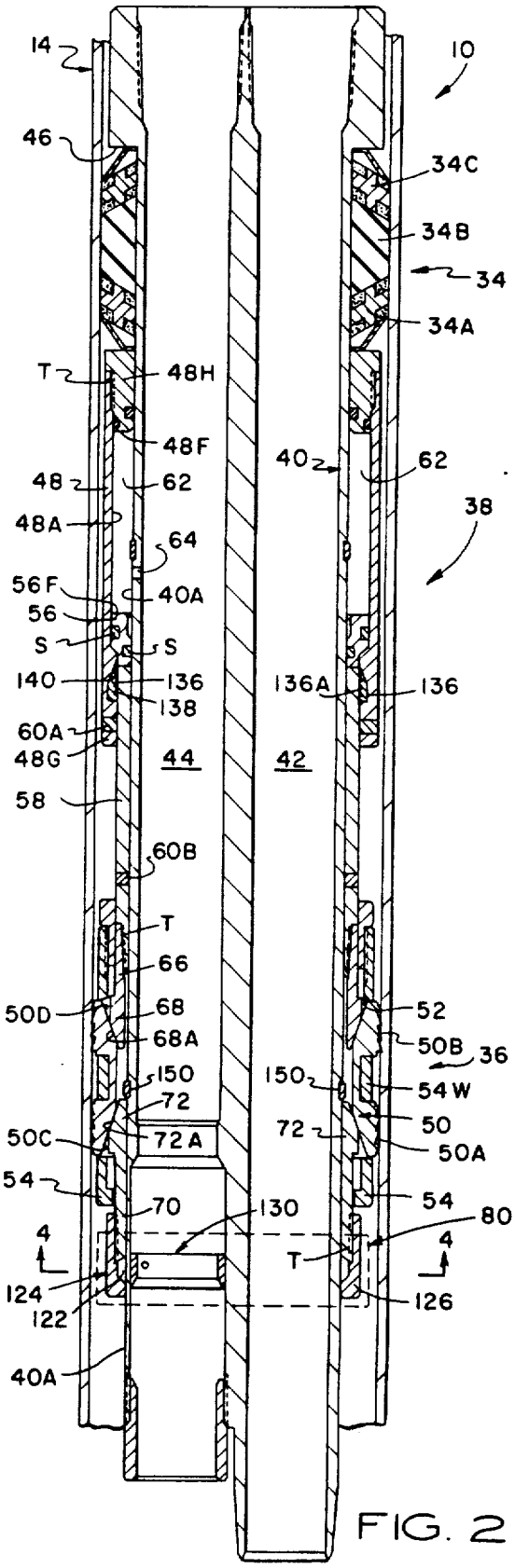
FIG. 2 is a longitudinal sectional view of the dual string production packer of FIG. 1 with its anchor slips and seal elements extended in the set position.

An exemplary embodiment of the present invention is illustrated in FIG. 1 and FIG. 2 in the form of a dual string hydraulic well packer 10 is shown in releasably set, sealed engagement against the bore 12 of a tubular well casing 14. The tubular casing string 14 extends through multiple layers of overburden 16 and traverses a first hydrocarbon formation 18. The lower liner casing string 14L, constructed of a corrosion resistant alloy material, intersects one or more layers of underburden 20 and then intersects a second hydrocarbon formation 22. The tubular casing sections 14, 14L which intersect the hydrocarbon formations 18 and 22 are perforated by multiple openings 24, 26, respectively, formed through the casing sidewall to permit entry of formation fluids from the producing formations 18, 22, respectively, into the well.

The well is sealed by a bottom packer 28 with an expendable sealing plug in place, and is set by electric wire line and explosive charge for isolation of the lower producing zone 22 after perforating and while working on the upper producing zone 18. After perforating the upper producing zone 18, a dual bore hydraulic packer 28 is installed against the bore 12 of the upper casing string 14. Each production zone 18, 22 is separately produced through an independent, primary tubing string 30 and a secondary tubing string 32. The dual production tubing strings 30, 32 are extended to a surface wellhead assembly (not illustrated). The portion of the primary tubing string 30 which is suspended below the dual bore packer 28 is preferably made of a flow-wetted CRA material, for example INCALOY 925. The single bore, permanent packer 28 includes an expandable seal element assembly 29 and anchor slip assembly 31 which are radially extendable to engage the bore 12L of the surrounding liner casing 14L.

Referring now to FIGURES and 2, the dual bore hydraulic packer 10 includes an expandable seal assembly 34 and a slip anchoring assembly 36, both radially extendable as described hereinafter to engage the bore 12 of the surrounding well casing 14. Additionally, the dual bore packer 10 includes a hydraulic actuator assembly 38 slidably mounted in sealing engagement onto a unitary packer mandrel body 40. The unitary packer mandrel body 40 is intersected by longitudinal flow passages 42, 44, which are connected in flow communication with the dual production tubing strings 30, 32, respectively.

The packer 10 has a 10,000 psi pressure rating, and is designed for 9⅞ inch, 62.8 pound casing. This packer embodiment includes a solid, one-piece hold down body mandrel 40 which is intersected by dual bores 42, 44. Each bore begins and is terminated with a premium box thread. The packer components are organized and mounted onto the short mandrel 40 which enables it to negotiate short, medium and long radius bends and to withstand high collapse pressures on the setting side of the packer below the seal elements.

The seal element assembly 34 is mounted directly onto the external surface of the packer body mandrel 40. The expandable seal assembly 34 includes a lower end seal element 34A, a center seal element 34B and an upper end seal element 34C. A two element package or single element package can be used, as desired. The outside seal elements 34A, 34C are preferably made of graphite impregnated wire mesh and the center seal element 34B is preferably made of a resilient polymeric material. The seal elements are rated for steam service at 550 degrees F. and are stacked in concentric alignment about a longitudinal axis between a radially stepped mandrel shoulder 46 and the head 48H of a setting cylinder 48.

Elastomeric/nitrile seal elements may be used for standard service applications. The type, shape, number and method of mounting the seal elements included in seal assembly 34 may be varied as known in the art while still providing a seal assembly that may be expanded radially to selectively engage a well bore surrounding the packer 10.

The slip anchor assembly 36 includes a plurality of anchor slips 50 which are mounted for radial movement through rectangular windows 52 formed in a tubular slip carrier 54. While the number of anchor slips 50 may be varied, the tubular slip carrier 54 is provided with an appropriate corresponding number of windows 52, with four anchor slips 50 being preferred. Each of the anchor slips 50 includes lower and upper gripping surfaces 50A, 50B, respectively, positioned to extend radially through the windows 52. The gripping edges are curved to conform with the cylindrical internal surface of the well casing bore 12. The wall area 54W of the slip carrier 54 between the paired rectangular windows 52 confines a bias spring for retracting the anchor slips 50 upon disengagement of the upper spreader cone. The bias spring maintains the gripping surfaces 50A, 50B retracted in the absence of setting forces, and yields to allow radial extension of the anchor slips in response to setting forces.

The expandable seal elements 34A, 34B, 34C have longitudinally aligned bores through which the packer mandrel 40 is received in slidable, sealing engagement therewith.

The hydraulic actuator assembly 38 includes the annular setting cylinder 48 and a setting piston 56. The external surface of the setting piston 56 is sealed against the inside diameter bore 48A of the setting cylinder by an 0-ring seal S. The internal bore surface of the setting piston 56 is sealed against the external surface 46A of the packer mandrel 40 by an 0-ring seal S. The lower end of the setting cylinder is initially secured to a tubular piston extension 58 by shear screws 60, which are shown separated into shear screw segments 60A, 60B.

The setting cylinder head 48H has a end face 48F which defines the upper boundary of a variable volume pressure chamber 62. The lower boundary of the variable volume pressure chamber 62 is defined by the annular end face 56F of the piston 56. The external sidewall surface 40A of the packer mandrel 40 and the internal sidewall surface 48A of the setting cylinder 48 define radial boundaries for the pressure chamber 62.

Hydraulic fluid enters the pressure chamber 62 through a setting port 64. The setting port 64 is a small radial bore which radially intersects the packer mandrel 40 and opens into the secondary production bore 44. According to this arrangement, the secondary production bore 44 is closed by a plug such as a drop ball which is dropped through the bore of the tubing string 32. After the mandrel bore 44 is closed, the pressure chamber 62 is pressurized with hydraulic fluid pumped through the secondary tubing string 32. Hydraulic fluid flows through the setting port 64 into the hydraulic pressure chamber 62, thereby applying hydraulic pressure against the piston face 48F and the setting cylinder face 48F.

Setting forces are transmitted to the anchor slips 50 through the tubular piston extension 58 to a movable setting wedge 66. The setting wedge 66 includes a spreader cone 68 which is engagable with the anchor slip assembly 36. The setting wedge 66 is secured against inadvertent set while running into the well by the shear screws 60 which interconnect the setting cylinder 48 and the tubular piston extension 58. The shear screws 60 are threaded into tapped bores formed through the tubular piston extension 58 and the guide shoulder 48G of the setting cylinder 48. According to this arrangement, the setting piston 56 and the setting cylinder 48 are releasably blocked from inadvertent extension against the slip element assembly 36 and expandable packing seal elements 34 during run-in.

The lower setting wedge 70 has a spreader cone 72 with an upwardly facing frustoconical wedging surface 72A which is generally complementary to a downwardly facing cam surface 50C formed on the lower anchor slip 50A. Likewise, the slip cone 68 of the upper setting wedge 66 has a downwardly facing frustoconical wedging surface 68A which is generally complementary to an upwardly facing cam surface 50D formed on the upper anchor slip 50B. According to an important feature of the invention, a lower tubular wedge 70 is releasably secured to the packer mandrel 40 by a lock assembly 80 for limiting longitudinal travel of the anchor slips 50 and for reacting setting forces transmitted by the setting piston 56 and the tubular piston extension 58.

Figure 3:
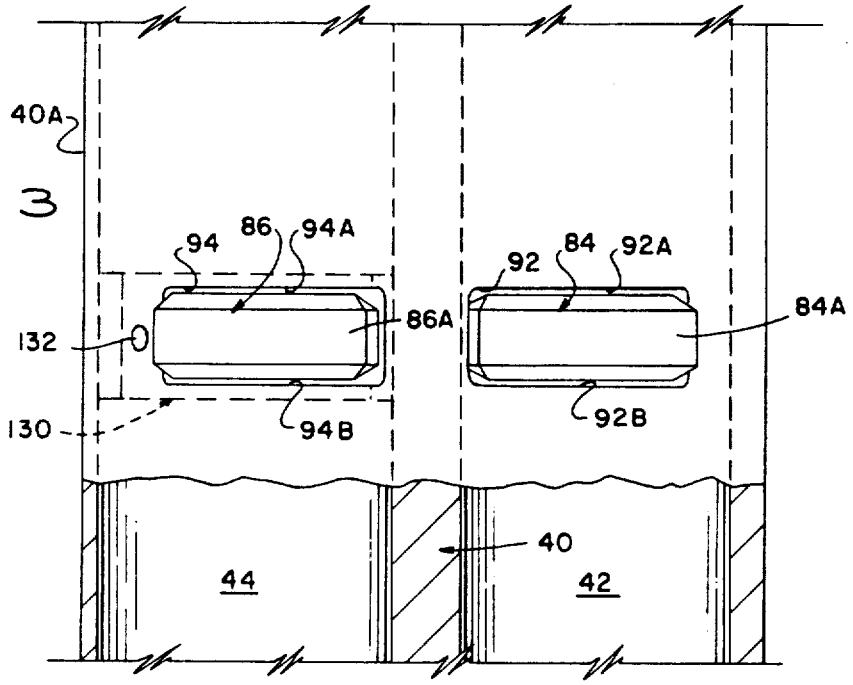
FIG. 3 is an elevational view, partially broken away, of the packer mandrel and locking apparatus.
Figure 4:
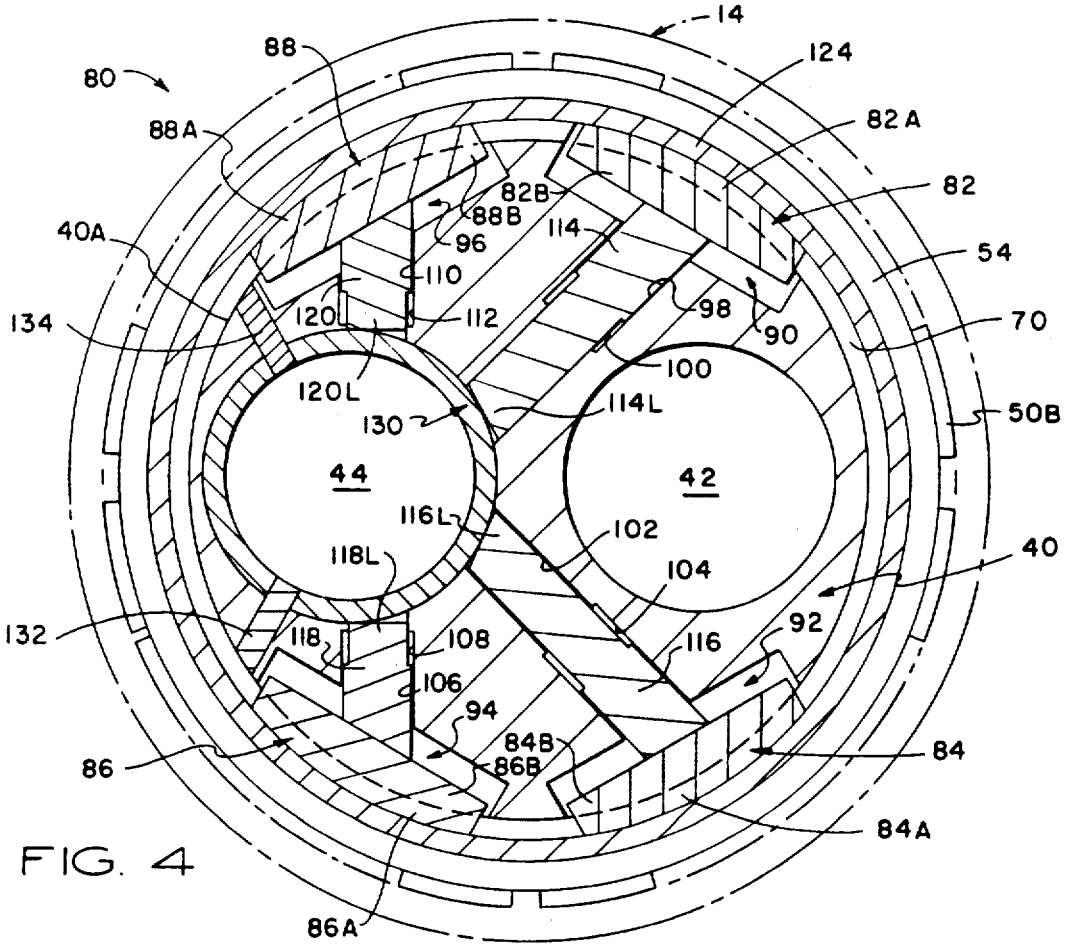
FIG. 4 is a sectional view of the locking apparatus in the locked position taken along the line 4—4 of FIG. 2.

Axial compression forces transmitted by the piston 56 through the tubular piston extension 58 are reacted through the lower wedge 78 and the lock assembly 80. Referring now to FIG. 2, FIG. 3 and FIG. 4, the lower tubular wedge 70 is releasably coupled to the packer mandrel 40 by the lock assembly 80 which includes a plurality of locking dogs 82, 84, 86 and 88. Each locking dog is dimensioned for radial extension and retraction within a slot or pocket 90, 92, 94 and 96, respectively. As shown in FIG. 4, the pockets 90, 92, 94 and 96 are formed in the mandrel body 40 and are circumferentially spaced with respect to each other at intermediate mandrel body locations between the production bores 42, 44. Moreover, the mandrel body 40 is also intersected by transverse bores and counterbores 98, 100; 102, 104; 106, 108; and, 110, 112, respectively. The bores and counterbores extend transversely through the packer mandrel body 40 and provide an open passage between each locking dog pocket and the production bore 44.

The locking dogs 82, 84, 86 and 88 are engaged by brace rods 114, 116, 118 and 120, respectively. Each brace rod is slidably received Within each guide passage defined by the bores and counterbores, and is blocked against retraction on one end by a shifting sleeve as discussed below. The length of each brace rod is adjusted so that its lug end portion (114L, 116L, 118L and 120L) is flush with the bore of the production passage 44 when the locking dog is extended out of its pocket and into an annular slot 122.

The annular slot 122 is defined between the external mandrel surface 40A and the internal bore of a threaded retainer collar 124. The retainer collar 124 has a radially inwardly projecting shoulder !26 which is disposed in slidable engagement against the external body mandrel surface 40A. The retainer collar 124 has an internal bore 128 which is radially spaced from the external surface 40A of the packer mandrel by the shoulder portion 126. In this arrangement, the lower wedge 70 is rigidly attached to the retainer collar 124 by a threaded union T.

The lower wedge 70 and the retainer collar 124 are releasably locked against the body mandrel 40 by the locking dogs 82, 84, 86 and 88 which are radially extended into the annular pocket 122, thereby preventing longitudinal displacement of the retainer collar 124 and the lower wedge 70 during run-in and production operations. Each locking dog also has a first body portion (82A, 84A, 86A and 88A, respectively) which projects into the annular pocket 122 and is confined axially between the lower end portion 70A of the lower wedge 70 and the radial shoulder portion 126 of the retainer collar. Each locking dog includes a second body portion (82B, 84B, 86B and 88B, respectively) which is confined axially by the upper and lower mandrel slot faces (90A, 90B; 92A, 92B; 94A, 94B; and, 96A, 96B, respectively).

Figure 6:
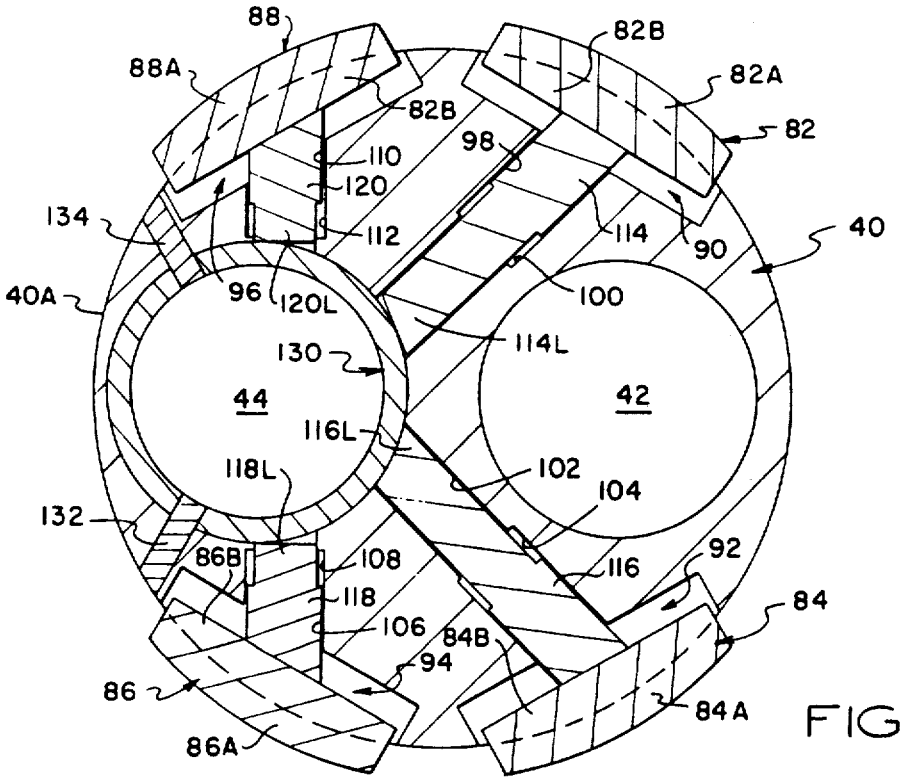
FIG. 6 is a sectional view of the locking apparatus taken along the line 6—6 of FIG. 5.

During run-in and production operations, the locking dogs are maintained in their extended, locked position as shown in FIGS. 3, 4 and 6 by a shifting sleeve 130 which is received within the longitudinal production bore flow passage 44 in blocking engagement with the brace rods 114, 116, 118 and 120. The shifting sleeve 130 is releasably secured in blocking engagement within the secondary flow passage 44 by shear pins 132, 134. The shear pins 132, 134 are secured by interference fit in bores formed through the shifting sleeve 130 and the packer mandrel body 40. According to this arrangement, the brace rods 114, 116, 118 and 120 are releasably blocked against retraction, and the locking dogs 82, 84, 86 and 88 are maintained in extended, locked engagement with the packer mandrel 40 and retainer collar 124.

Consequently, run-in forces caused by jarring, torquing and compression/tension loading as the dual bore packer 10 is forced through tight bends, for example in deviated bores and in horizontal completions, are reacted through the locking dogs and the packer mandrel. The run-in handling forces are decoupled with respect to the release shear screws, setting piston and setting cylinder, thereby avoiding inadvertent set during a run-in operation. During production, static loading forces from above the packer and annulus pressure loading applied from below the packer are reacted through the locking dogs and packer mandrel.

The locking dogs are confined radially and are blocked against retraction by compression of the brace rods against the shifting sleeve 130, and are confined within the annular pocket 122 by the internal sidewall bore 128 of the retainer collar 124. Each locking dog is confined against longitudinal displacement by the upper and lower packer mandrel faces (90A, 90B; 92A, 92B; 94A, 94B; and, 96A, 96B) of each locking dog pocket.

According to this arrangement, the locking dogs 82, 84, 86 and 88 oppose setting forces which are applied to the anchor slips 50 by the piston 5 and tubular extension 58. During setting, the slip carrier 54 and anchor slips 50 are extended along the packer mandrel 40 toward the retainer collar 124. As that occurs, further extension of the piston 56 and tubular extension 58 drives the setting wedge 66 and spreader cone 68 into engagement with the upper anchor slips 50B, and the lower anchor slips 50A are driven against the spreader cone 72 of the lower wedge 70.

As the piston 56 is extended in response to pressurization of the variable volume pressure chamber 62, setting forces are transmitted through the tubular piston extension 58 and the lower setting wedge 66 to the anchor slip assembly 36, and are reacted by the lock assembly 80 and mandrel 40 as the anchor slips 50 are extended radially outwardly. The setting forces are also transmitted through the setting cylinder head 48H to the seal element assembly 34, and are reacted by the mandrel body shoulder 46. In the set position as illustrated in FIG. 2, the setting wedge 68 is fully extended relative to the anchor slip assembly 36, and consequently, the anchor slips 50 are fully extended within the windows 52 by the biased compression springs. As the conical wedge surface 68A of the setting piston 68 is driven into engagement with the sloping wedge surface of the anchor slip, the anchor slips are displaced radially outwardly as the upper and lower spreader cones engage and slip along the sloping cam surfaces.

The set position of the setting wedge 66 and the setting cylinder 48 is secured by the unidirectional ratcheting action of segmented, internal locking slips 136 which are carried between the setting cylinder 48 and the piston extension 58. The ratchet slips 136 are carried within a slip pocket 138 having a tapered counterbore 140 formed along the inside bore of the setting cylinder 48.

Each locking slip 136 has downwardly facing threads 136A which engage and bite into the external surface of the tubular piston extension 58. The downwardly facing threads permit the setting cylinder 48 to ratchet upwardly along the piston extension external surface as the piston 58 and setting cylinder head 48H are extended, but retraction movement is prevented by the wedging action and biting engagement of the locking slip against the tubular piston extension 58. The locking action of the ratchet slips 136 prevents retraction movement since retraction would cause the threads to wedge the slips even tighter into biting engagement against the piston extension 58. Consequently, once the setting cylinder 48 and the piston 56 have been fully extended, the seal elements 34 are compressed and extended into sealing engagement with the casing bore 12, the setting wedge 66 is concurrently moved downwardly, driving the anchor slips 50 into set engagement against the well bore 12. The set position is securely locked against retraction by the locking slips 136 after the hydraulic setting pressure has been removed.

Upon application of hydraulic pressure into the variable volume pressure chamber 62, the pressure force is increased until the shear strength of the shear screws 60 is overcome. As the shear screws 60 separate, the setting cylinder head 48H is released and is extended against the annular packing seal element 34A.

After the seal elements 34 and anchor slips 50 have been set, hydraulic pressure is relieved and the plug P is removed, for example by a wire line tool, or by pressurizing the secondary mandrel until the plug housing seat is fractured and the plug P is discharged into the annulus above the bottom packer 28. The well is then completed and ready for production.

Figure 5:
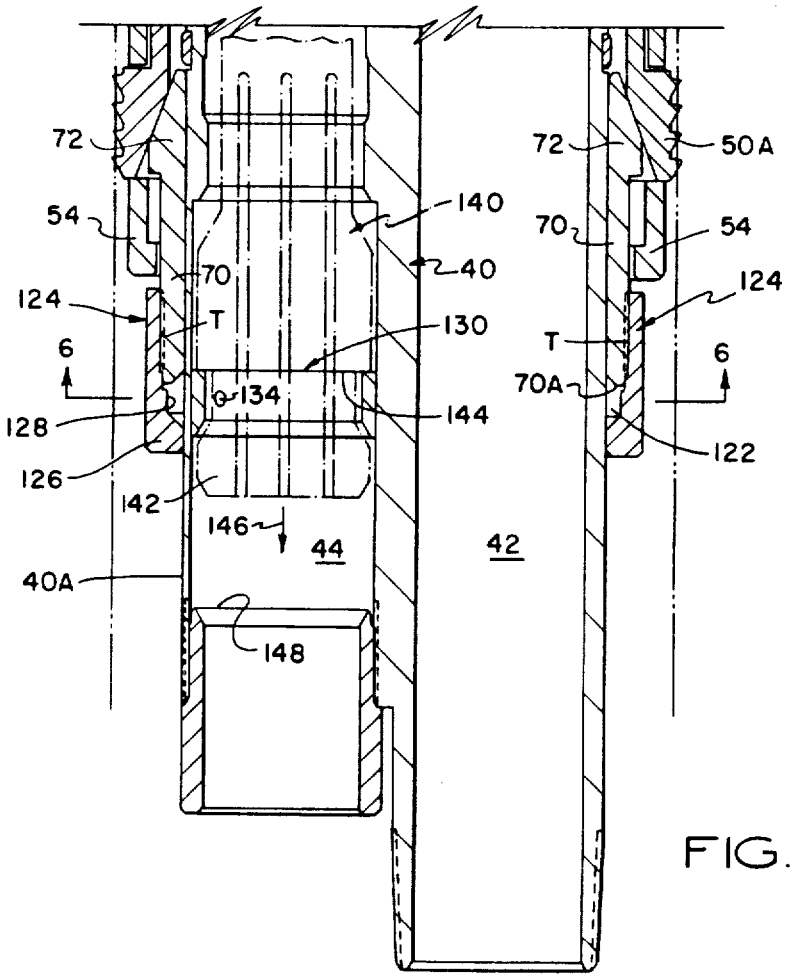
FIG. 5 is a longitudinal sectional view, partially broken away, of the dual string production packer of FIG. 1, showing engagement with a wire line release tool.
Figure 7:
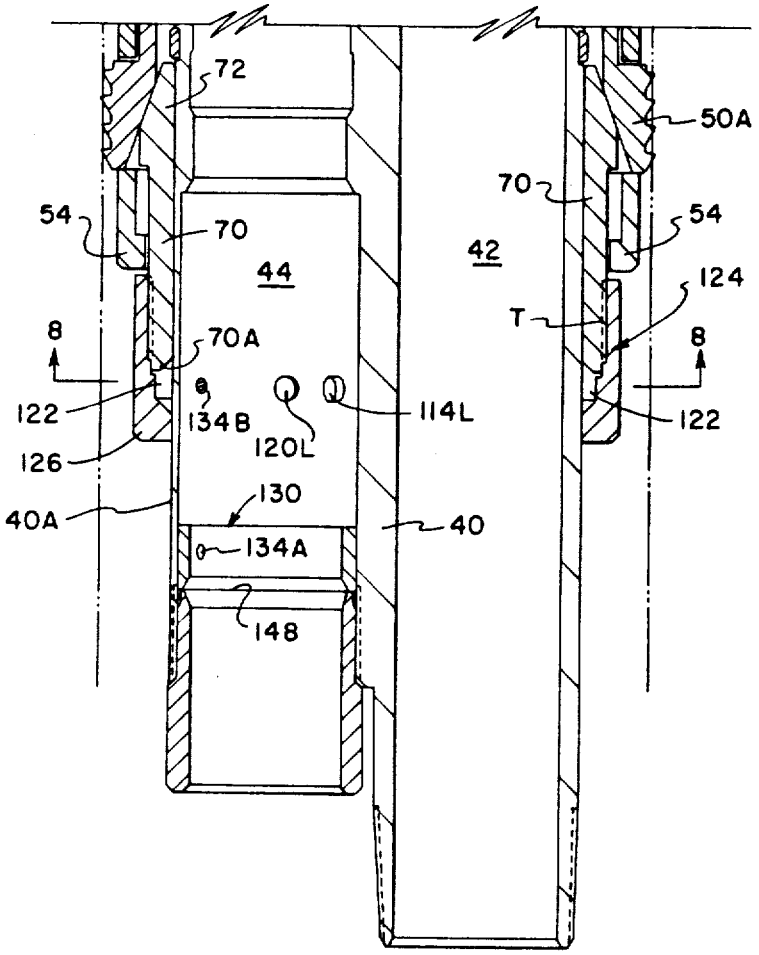
FIG. 7 is a view similar to FIG. 5 which illustrates the released position of the locking apparatus of the present invention; and, FIG. 8 is a sectional view of the locking apparatus in the released position taken along the line 8—8 of FIG. 7.

Referring now to FIG. 5 and FIG. 7, the packer 10 is releasable from the set configuration by applying a wire line shifting tool 140 against the shifting sleeve 130 to cause separation of the shear pins 132, 134 and displacement of the shifting sleeve out of blocking engagement with the brace rods. The wire line shifting tool includes multiple keys 142 which are spring loaded. As the shifting tool 140 engages the shifting sleeve 130, the keys momentarily deflect as they are inserted through the bore of the shifting tool 130. Upon full insertion, the keys 142 spring outwardly and a shoulder 144 on the shifting tool engages the top annular face of the shifting sleeve. Jarring forces are then applied through the shifting tool to cause the shifting sleeve 130 to cause separation of the shear pins 132, 134 and downward displacement of the shifting sleeve as indicated by the arrow 146. Once the pins have been sheared, cam surfaces on the keys engage a retainer shoulder 148, which causes radial inward deflection of the keys relative to the shifting sleeve. As the keys deflect, the shifting sleeve is released and the wire line tool can then be retrieved to the surface.

Figure 8:
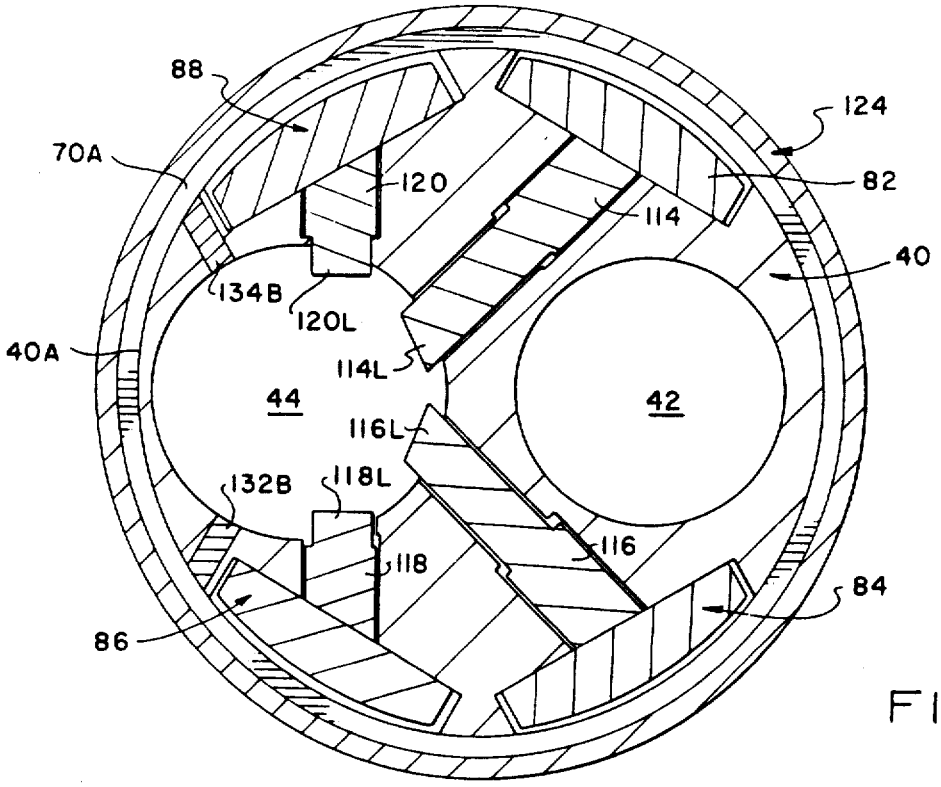

Referring now to FIG. 7 and FIG. 8, upon downward displacement of the shifting sleeve 130, the brace rods 114, 116, 118 and 120 are unblocked and are free to travel radially inwardly. This allows free travel of the locking dogs, which travel inwardly and unlatch the retainer collar 124 and lower setting wedge 70 from the packer mandrel 40. In the released position as shown in FIG. 7 and FIG. 8, the brace rods project radially into the secondary production bore 44, and the locking dogs are fully retracted within the mandrel pockets 90, 92, 94 and 96. Upon full retraction of the locking dogs, the lower setting wedge 70 and slip carrier 54 are released from the mandrel, and the packer 10 is then retrieved by a straight upward pull as the anchor slips are released. Once the lower wedge 70 and the anchor slips have been released, as the packer mandrel is moved up by tension applied to either tubing string 30, 32, a snap ring 150 mounted in an annular groove about the packer mandrel 40 engages the upper setting wedge 68 and pulls it away from the anchor slips 50, thereby completing the release.

The packer components are protected against premature release during production by the lock assembly 80. According to this arrangement, any pressure applied from below the packer acts across the locking dogs and packer mandrel 40. Loading imposed by the tubing strings 30, 32 above the packer is reacted through the packer mandrel, the locking dogs and the anchor slips into the surrounding well casing.

The dual bore packer mandrel body 40 is substantially stronger than conventional dual bore packers which utilize separate packer mandrels for supporting the anchor slips. Accordingly, the collapse strength and weight carrying capacity of the packer 10 are substantially increased as compared with conventional thin walled, dual mandrel packers.

While a preferred embodiment of the invention have been set forth for purposes of disclosure, modification to the preferred embodiment as well as other embodiments thereof may occur to those skilled in the art. Accordingly, the appended claims are intended to cover all embodiments of the invention and modifications to the disclosed embodiment which do not depart from the spirit and scope of the invention.

What is claimed is:

1. A well packer comprising, in combination:

a body mandrel having a bore defining a longitudinal flow passage;

a seal element assembly mounted on said body mandrel;

an anchor slip assembly mounted on said body mandrel;

force transmitting apparatus movably coupled to said seal element assembly and said anchor slip assembly for extending said seal element assembly and said anchor slip assembly into set engagement against a well bore;

tubular wedge apparatus coupled to the body mandrel 13 and engagable by said anchor slip assembly for limiting longitudinal travel of said anchor slip assembly and reacting setting forces transmitted thereto; and, releasable lock apparatus coupling the tubular wedge apparatus to the body mandrel for opposing longitudinal movement of the tubular wedge apparatus relative to the body mandrel.

2. A well packer as defined in claim 1, said releasable lock apparatus comprising:

a locking dog movably mounted on the body mandrel for extension and retraction into and out of engagement with the tubular wedge apparatus;

a shifting sleeve releasably secured within the body mandrel bore; and, a brace rod projecting through the body mandrel, said brace rod having a first end portion engagable against the shifting sleeve and a second end portion engagable against the locking dog for blocking retraction of the locking dog out of locking engagement with the tubular wedge apparatus.

3. A well packer as defined in claim 1, said releasable lock apparatus comprising:

a radial slot intersecting said body mandrel and communicating with the longitudinal flow passage;

a pocket formed in said tubular wedge apparatus;

a locking dog having a first body portion and a second body portion, said locking dog being radially movable from a locked position in which the first body portion and the second body portion are disposed in the body mandrel slot and the wedge pocket, respectively, to a released position in which the second body portion is retracted out of the wedge pocket;

a brace rod engaging the locking dog and projecting through the body mandrel slot;

a shifting sleeve disposed in the longitudinal flow passage in blocking engagement with the brace rod; and, at least one shear pin releasably securing the shifting sleeve to said body mandrel.

4. A well packer as defined in claim 1, said tubular wedge apparatus including a retainer collar secured to said wedge, said retainer collar having a tubular sidewall radially spaced from said packer mandrel thereby defining an annular pocket, and having an inwardly projecting shoulder disposed in slidable engagement with said body mandrel, and said releasable lock apparatus including a locking dog mounted for extension and retraction relative to said packer mandrel, said locking dog being extendable into and retractable out of said annular pocket.

5. In a retrievable well packer of the type including a body mandrel having a bore defining a longitudinal flow passage, an anchor slip assembly and a seal element assembly movably mounted on said mandrel, and tubular wedge apparatus mounted on said mandrel for engagement with the anchor slip assembly for limiting longitudinal travel of the anchor slip assembly and for opposing setting forces applied to the anchor slip assembly, the improvement comprising:

a locking dog movably mounted on the body mandrel for extension and retraction into and out of engagement with the tubular wedge apparatus;

a shifting sleeve releasably secured within the body mandrel bore; and, a brace rod projecting through the body mandrel, said brace rod having a first end portion engagable against the shifting sleeve and a second end portion engagable against the locking dog for blocking retraction of the locking dog out of locking engagement with the tubular wedge apparatus.

6. An improved packer as defined in claim 5, said tubular wedge apparatus including a retainer collar secured to said wedge, said retainer collar having a tubular sidewall radially spaced from said packer mandrel thereby defining an annular pocket, and having an inwardly projecting shoulder disposed in slidable engagement with said body mandrel, and said releasable lock apparatus including a locking dog movably mounted on said mandrel, said locking dog being extendable into and retractable out of the annular pocket.

7. In a subterranean well having a casing embedded within a producing formation, a packer engaging said casing and having a mandrel supporting production equipment within said well, said mandrel having a longitudinal bore defining a production flow passage, force transmitting means mounted on said packer mandrel for setting an anchor slip assembly and seal element assembly against said casing, and tubular wedge apparatus disposed for engagement with said anchor slip assembly for limiting longitudinal travel of said anchor slip assembly and for opposing setting forces applied to said anchor slip assembly, the improvement comprising:

releasable lock apparatus coupling the packer mandrel to the tubular wedge apparatus for opposing longitudinal movement of the packer mandrel relative to the tubular wedge apparatus.

8. The improvement as defined in claim 7, said releasable lock apparatus comprising:

a retainer collar secured to said wedge, said retainer collar having a tubular sidewall radially spaced from said mandrel thereby defining an annular pocket, and having an inwardly projecting shoulder disposed in slidable engagement with said packer mandrel; and, releasable lock apparatus including a movable lock member projecting transversely through the packer mandrel, said movable member being extendable into and retractable out of said annular pocket.

9. A well packer as defined in claim 7, said releasable lock apparatus comprising:

a radial slot intersecting said packer mandrel and communicating with the longitudinal flow passage;

a pocket formed in said tubular wedge apparatus;

said movable lock member having a first body portion and a second body portion, said lock member being extendable to a lock position in which the first body portion and the second body portion are disposed in the packer mandrel slot and the wedge pocket, respectively, to a release position in which the second body portion is retracted out of the wedge pocket;

a brace rod engagable with the lock member and projecting through the packer mandrel slot;

a shifting sleeve disposed in the longitudinal flow passage in blocking engagement with the brace rod; and, at least one shear pin releasably securing the shifting sleeve to said packer mandrel.

10. In a well packer of the type having a body mandrel intersected by a longitudinal bore defining a production flow passage and having a tubular wedge disposed for engagement by a movable anchor slip assembly for limiting longitudinal travel of the anchor slip assembly and for reacting setting forces applied to the anchor slip assembly, the improvement comprising:

a locking dog movably mounted on the body mandrel for extension and retraction into and out of engagement with the tubular wedge;

a shifting sleeve releasably secured within the body mandrel bore; and, a brace rod projecting through the body mandrel, said brace rod having a first end portion engagable against the shifting sleeve and a second end portion engagable against the locking dog for blocking retraction of the locking dog out of locking engagement with the tubular wedge apparatus.

* * * * *